United States Patent [19]

Rosenfeld

[11] 4,323,242

[45] Apr. 6, 1982

[54] ELECTRONIC MAZE GAME

[76] Inventor: Peter E. Rosenfeld, 149 Mountain Ave., Berkeley Heights, N.J. 07922

[21] Appl. No.: 189,583

[22] Filed: Sep. 23, 1980

[51] Int. Cl.[3] ..... A63F 9/06

[52] U.S. Cl. ..... 273/153 R; 273/1 GC

[58] Field of Search ..... 273/1 GC, 1 GE, 1 E, 273/153 R, 138 A, 237, DIG. 28; 434/201; 364/410, 411

[56] References Cited

U.S. PATENT DOCUMENTS

| | | | |
|---|---|---|---|
| 4,051,605 | 10/1977 | Toal et al. | 434/201 |
| 4,103,895 | 8/1978 | Pressman et al. | 273/153 R |
| 4,126,851 | 11/1978 | Okor | 273/237 |
| 4,240,638 | 12/1980 | Morrison et al. | 273/153 R |
| 4,249,734 | 2/1981 | Bromley | 273/94 |
| 4,275,443 | 6/1981 | Sorin | 273/237 |

FOREIGN PATENT DOCUMENTS

| | | | |
|---|---|---|---|
| 2040695 | 9/1980 | United Kingdom | 273/1 GE |

*Primary Examiner*—Vance Y. Hum

[57] ABSTRACT

An electronic maze game comprising a maze which is stored electronically in the memory of a microcomputer, a four bar display which indicates if there is a wall or an opening immediately above, below, right or left of the player's present position, and four push buttons which permit the player to make a move from his present position to the adjacent position lying above, below, to the right or left, provided that such move is not blocked by a wall. A number of different mazes are stored in the game, and the player may choose to play a "beginner", "intermediate" or "advanced" game, or repeat the last game played. A two digit display tells the player at the beginning of the game the minimum number of moves required to transit the maze, and during play of the game, the number of moves the player has made.

8 Claims, 4 Drawing Figures

ELECTRONIC MAZE GAME

SUMMARY OF THE INVENTION

This relates to a game in which one or more players try to work their way out of a maze in a minimum length of time, or in a minimum number of moves, using a display which shows them only the structure of the maze in their immediate vicinity.

In a prefered embodiment of the invention, a four bar display, arranged in the shape of a square, indicates if there is a wall or an opening immediately above, below, right and left of the player's present position. Four push buttons are used by the player to make a move from his present position to the adjacent position lying above, below, to the right or left, provided that such movement is not blocked by a wall. A two digit display tells the player at the beginning of the game the minimum number of moves required to transit the maze, and during play of the game, the number of moves the player had made.

A number of different mazes are stored in the game, and the player may choose to play a "beginner", "intermediate", or "advanced" game, or repeat the last game played. In its present embodiment, the game contains four beginning, four intermediate and eight advanced mazes, and a random number generator is used to select the particular maze from within the category the player has chosen.

When the game is played by a single player, the object is to complete it in the minimum number of moves, which means that the player will normally repeat a particular maze a number of times, trying to improve his performance by avoiding dead ends or circituitous paths encountered on previous tries. For play by more than one person, provision is made for connecting two or more units together using a signaling cable, which causes all units to display the same maze, and to halt play on all units when any player completes the game. At the moment that the game is won, the winner's display shows all four bars, and the losers' displays show no bars. The winner is now allowed to select the next game to be played, and as soon as it is transmitted over the cable to the other units, play resumes. The ability to connect a number of units together over a cable is considered an important feature of this game, as it allows a number of players to make moves simultaneously rather than in sequence as is usual in games for multiple players. This may make the game more exciting to children who get impatient waiting for a turn. It also allows the game to be played by people in different rooms, which may also have appeal to children.

BRIEF DESCRIPTION OF THE DRAWINGS

These and other objects, features, elements and advantages of my invention will be more readily apparent from the following detailed description of the invention in which.

BEST MODE OF CARRYING OUT THE INVENTION

Figure 1:
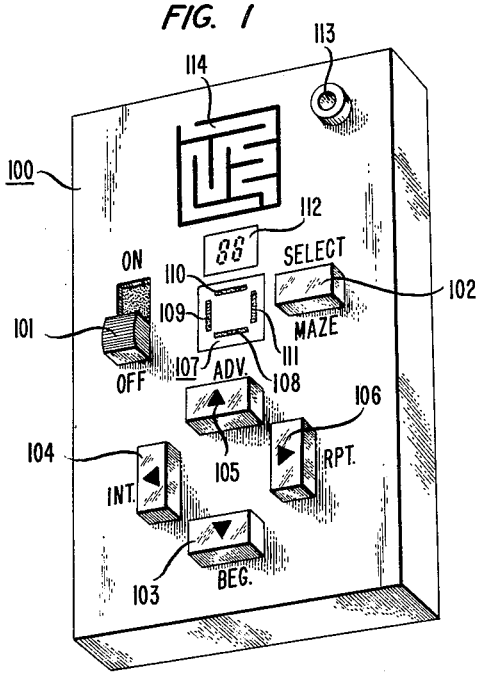
FIG. 1 is a depection of an illustrative embodiment of my invention, packaged in a hand-held case.

FIG. 1 depicts an electronic maze game 100 of my invention as it would be packaged in a hand held case. Shown in the middle is a four bar display 107 comprising a bottom bar 108, a left bar 109, a top bar 110 and a right bar 111. To the left of the four bar display is an On/Off switch 101. To the right of the four bar display is a Select Maze push button 102. Below the four bar display are four move push buttons, a Move Down button 103, a Move Left button 104, a Move Up button 105, and a Move Right button 106. These same four buttons are used immediately after the Select Maze button 102 has been pressed to select a beginner, intermediate, or advanced level game or a repeat of the last game played, respectively. Shown above the four bar display is a two digit Seven Segment display 112 which is used immediately after a game has been selected to display the minimum number of moves to solve the particular maze, and is used after the first move has been made to display the number of moves the player has made. In the upper right hand corner is a jack 113 used to connect to similar other maze games (not shown) over a two conductor cable (not shown). At the top of the case is shown a picture 114 of one of the 16 mazes stored in the memory of the game, in particular, one that can be selected by pressing the Select Maze and Move Right (Repeat Game) buttons immediately after turning on the On/Off switch. This maze is pictured on the case as an aid to a first time user of the game, to help him understand its operation.

Figure 2:
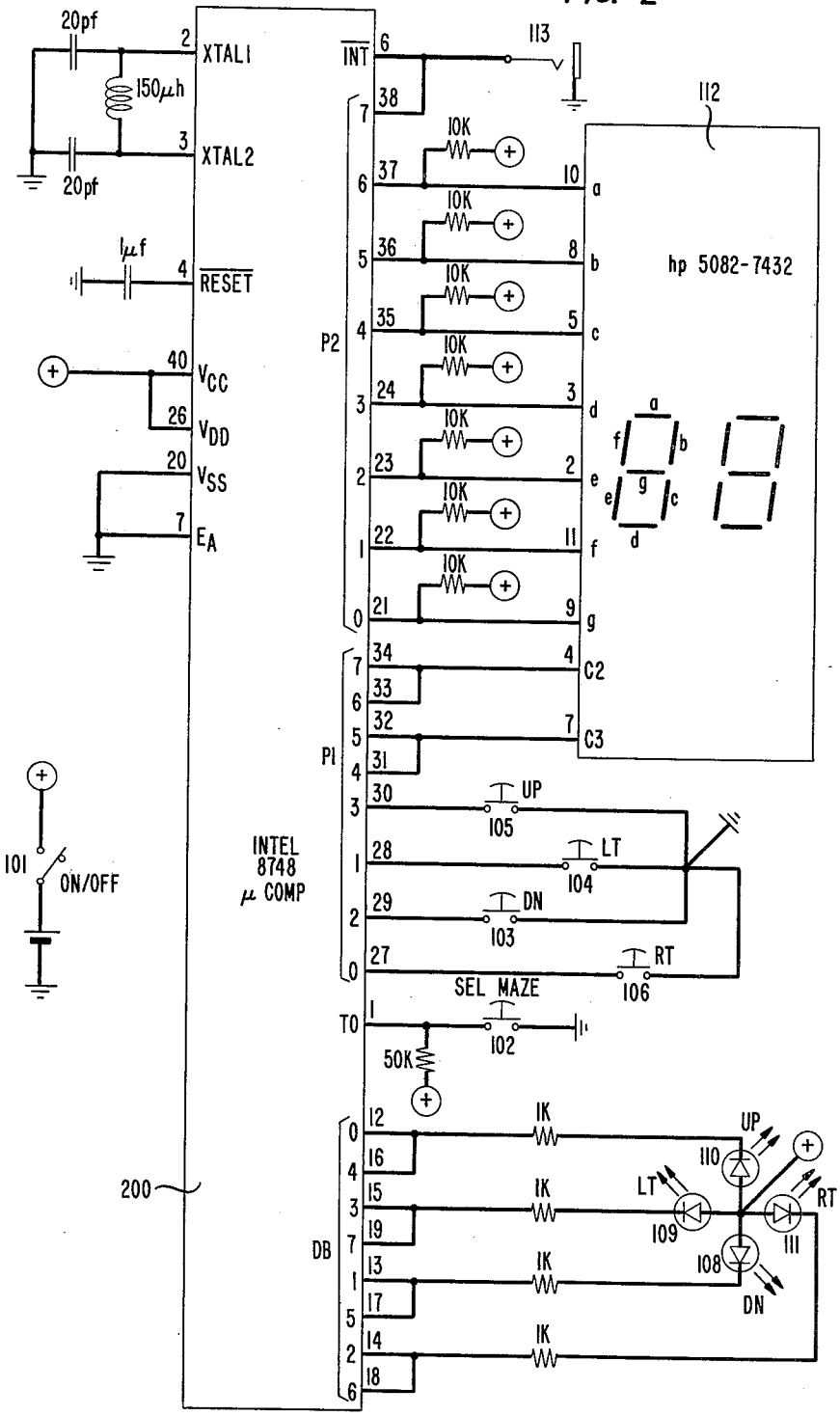
FIG. 2 is a schematic diagram of electronic circuitry suitable for implementing the illustrative embodiment of FIG. 1.

FIG. 2 is an electrical schematic diagram showing how to implement the game with a particular set of electronic components, in particular an Intel Corporation 8748 microcomputer integrated circuit 200 and a Hewlett Packard Corporation two digit seven segment display. The reader who is not familiar with the operation of the Intel Corporation 8748 microcomputer is refered to the Intel Corporation publication "MCS-48 MICROCOMPUTER USER'S MANUAL", copyright 1978. For convenience, elements common to FIG'S. 1 and 2 are identified by the same numbers. It is to be understood that this game could be implemented with microcomputers and displays manufactured by others, but a different wiring diagram would result.

Figure 3:
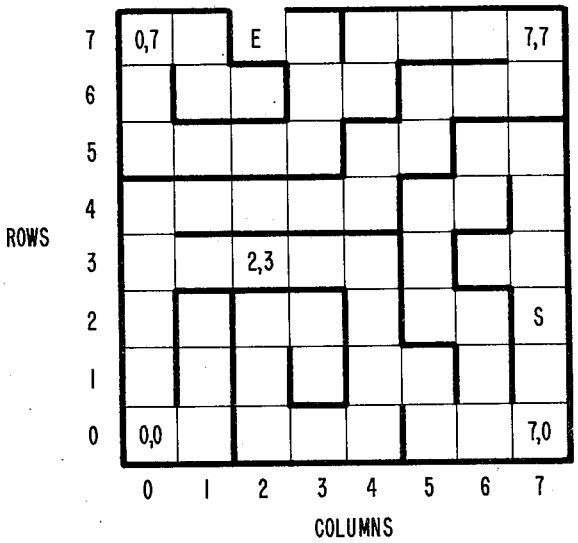
FIG. 3 is an illustrative example of a maze which may be played with the embodiment of FIG. 1.

In a preferred embodiment of my invention each maze is a two-dimensional square maze, and 16 such mazes are stored in a table in the memory of the microprocessor. Four of these mazes are beginner level $4\times4$ mazes, four are intermediate level $6\times6$ mazes, and eight are advanced level $8\times8$ mazes. An illustrative such $8\times8$ maze is shown in FIG. 3.

To store the maze and determine movement through the maze, each maze is regarded as composed of m by n cells and each cell is represented by a number having the from a,b where a represents the column in which the cell is located and b represents the row. For convenience, the rows and columns of the $8\times8$ maze of FIG. 3 are numbered, and the corner cells are designated 0,0 0,7 7,7 and 7,0 proceeding clockwise from the lower lefthand corner. The designation of the other cells will be apparent. A player's position in the maze can therefore be represented by the number a,b of the cell where the player is; and this number can be stored by one or more registers of microprocessor 200.

The maze itself is stored in a table which indicates in binary notation for each dimension of each cell whether there is or is not a wall in the direction of forward or backward movement from that cell in that particular dimension. This table can be stored in a number of ways. To minimize storage requirements, I store only one representation of each wall in the maze; and to facilitate processing, I store together the binary representations of all the walls in a particular row or column of the maze. Thus, the walls in column 1 of the maze of FIG. 3 are represented electronically in the memory of the microprocessor 200 by the binary number 100111101; and the walls in row 1 of the maze of FIG. 3 are represented electronically by the binary number 111110111. As will be apparent, nine binary digits are needed to represent the nine walls in a row or column of an $8\times8$ maze, but since the maze is assumed to have a continuous outer wall, there is no need to represent the first or last of these walls in memory.

During play, the configuration (i.e. the presence and absence of walls) of the cell in which the player is then located is constantly displayed by four bar display 107 with lighted bars 111, 109 representing the presence of walls in the forward and backward directions of one dimension, and lighted bars 110, 108 representing the presence of walls in the forward and backward directions of the second dimension. Advantageously this display is controlled by a register into which the microprocessor has loaded the binary information from the maze table which indicates the presence or absence of a wall in the forward and backward directions in each dimension at the cell where the player is then located. Thus, if the player is located in cell 2,3 of the maze of FIG. 3, the processor reads from memory the binary number 10000110, representative of the walls of row 3, and shifts this number two digits to the left to read the binary number 0,0 from the two most significant bits, indicating there are no walls on the left and right hand sides (the backward and forward direction in one dimension) of cell 2,3. In like fashion, the processor also reads from memory the binary number 10011111 representative of the walls of column 2, and shifts this number three digits to the left to read the binary number 1,1 indicating there are walls at the top and bottom (the forward and backward directions in the second dimension) of cell 2,3. This information is provided to the register which controls the display.

Figure 4:
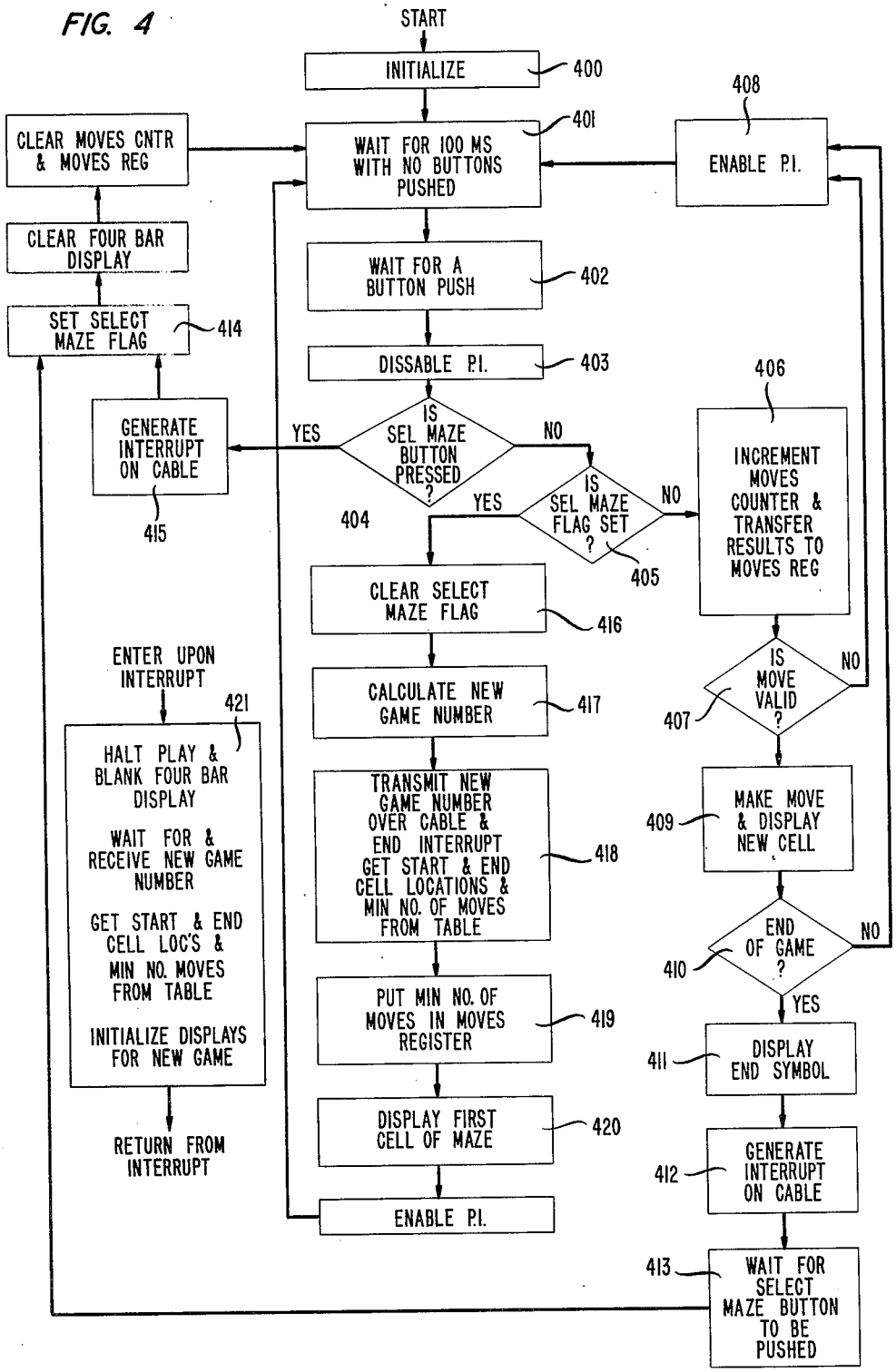
FIG. 4 is a flowchart of a computer program which may be stored in and executed by the electronic circuitry of FIG. 2 in the practice of my invention.

Movement through the maze is a matter of moving to the adjacent cell by incrementing or decrementing either the value of a or the value of b of the number a,b representing the cell where the player is. These steps are controlled by buttons 103–106. However, before a change in cell position can be made, the validity of the move must also be tested by checking for the absence of a wall in the direction of the move. Advantageously, the data that controls the display is used to test the validity of the move. FIG. 4 is a flow chart of the program stored in and executed by the microcomputer 200 in FIG. 2. At the top is shown an initialize block 400 which represents the code used to initialize the various registers, flags, and Input/Output (I/O) ports used later in the program. Below this is a Wait block 401 where the program loops until it detects a continuous period of 100 milliseconds during which none of the five push button switched 102–106 are operated, and thus serves to "debounce" the switches. Below this is a Wait block 402 where the program loops until it detects the operation of one of the aforementioned push buttons 102–106. Below this is a Disable Program Interrupt (P.I.) block 403 where the program disables the External Interrupt circuitry used to detect signals arriving via jack 113 from another unit. It is convenient to postpone recognizing these signals during the few milliseconds necessary to respond to a local button being pressed. Next, follows a Test block 404 where the program branches left if the "Select Maze" button 102 was pressed, and right if one of the four "Move" buttons 103–106 was pressed. In the latter event, a second test 405 is made to determine if a normal move is called for, or if the Move buttons are presently being used to select a new game. This test is done upon a flag set in a portion of code yet to be described. If a normal move is called for, the program proceeds to a block 406 which represents the code necessary to increment a register used to keep track of the number of moves made during the present game, and transfer the results to the register used to drive the two digit seven segment display. Next comes a test block 407 wherein the validity of the requested move is determined. The state of the four bar display is examined to determine whether or not a wall segment is indicated that would block the designated move. Should the move be invalid, the program returns via an Enable P.I. block 408 to the Wait block 401. In the case of a valid move, the program proceeds to a Move and Display block 409 wherein the data describing the next cell in the maze is retrieved from a table of maze data and used to update the four bar display. Next, a test 410 is made to determine if the maze cell just entered is the end of the maze. If the test 410 indicates it is not the last cell, the program returns via the Enable P.I. block 408 to the Test block 401. However, if the test 410 determines the cell just entered is the last in the game, the program proceeds to a display block 411 which causes all four bars of the four bar display to be illuminated, thus signaling the end of the game. Next follows a generate interrupt block 412 where the program causes a signal to be sent via jack 113 to other units 100, informing them that they have lost the game. There follows a wait block 413 where the program loops waiting to detect the pressing of the Select Maze push button. Next comes a Set Flag block 414 in which the flag tested in the test block 405 is set. This block 414 may also be entered from a Generate Interrupt block 415 which places the signal that halts play on the cable used to interconnect two or more game units.

Returning now to the Select Maze Flag test 305 we will examine the path taken if the flag is set, thereby indicating that a new game is in the process of being selected. First comes a Clear Flag block 416 which clears the flag just tested in test block 405. Next comes a Calculate New Game Number block 417 where a number obtained from a random number generator routine is used in conjunction with information about which of the four move buttons 103–106 was pressed, to select a new beginner, intermediate or advanced game number, or repeat the last game number. This is followed by a Transmit block 418 where the previously selected game number is transmitted in a pulse code format over the cable used to interconnect two or more game units. This block also contains the code to end the program interrupt initiated either in block 412 or 415, and the code to get from the maze table the information about the start, end, minimum number of moves to transit the game just selected in block 417. Next comes a block 419 in which the information about the minimum number of moves to transit the maze is sent to the seven segment display 112, and a display block 420 where the data defining the walls of the starting cell is sent to the four bar display 107.

Also shown in FIG. 4 is an Interrupt Service block 421 which is entered if an interrupt is received over the interconnecting cable. This code halts play and blanks the four bar display 107 to indicate that a player at another game unit has completed the maze and therefore won the game. Additional code then waits for and receives the game number for the next game to be played, when it is transmitted in pulse code over the interconnecting cable. This block also contains code to initiallize the four bar display 107 and the seven segment display 112 for the beginning of the new game. The purposes of the other blocks in FIG. 4 will be apparent to one skilled in the art of computer programming.

As will be apparent to those skilled in the art, numerous variations may be made in the above described game and method of play that are within the spirit and scope of the invention. While the game described above is a two dimensional maze game, expansion of the game to mazes of three and more dimensions will be apparent to those skilled in the art.

```
*MICROMAZE - Version 4 - Added code for moves counter & cable interrupts
*Data in page 3, 16 bytes per maze, 16 mazes.
*First 8 bytes are horiz bar info, MSB is bottom bar,
*first byte is for X = O column.
*Next 8 bytes are vert bar info, MSB is left bar,
*first byte is for Y = O row.
*Start and Stop locations in top of page 2, 2 bytes/game.
*Even addr. has Start loc., MS nibble = X, LS = Y
*Min. # moves/game in BCD in page 2 starting at 2dO
*r7 = XYend for present game
*r6 = pointer to data base addr for present game
*r5 = x r4 = y r3 = game no. (0-15)
*r2 = complement of bus, i.e.state of 4 bar display
*r0 & r1 are scratch pads used in button debounce.
*RB1 assignments - r7&4 save AC r5&6 number of moves
*P2 drives 7 seg. disp. - bits 6 to 0 = segments a to g
*P2 bit 7 connects to INTerupt for cable driver
*P1 bits 7 & 6 drive cathode 2 and 4&5 cath. 3 (C1 doesnt exist)
*P1 bits 0,1,2,3 read switches rt 1f dn up
*T0 reads reset sw
*Bus drives 4 bar disp. bits 0&4 top 1&5 bot, 2&6 rt, 3&7 1ft
*To get vert bars, add 8 to Y value plus maze base addr
*to get addr of bye to be shifted left X times. Bits
*7 and 6 then define state of vert bars.
*To get horiz bars, add X value ot maze base addr to form
*address of data byte which is then shifted left Y times.
*Then use bits 7 and 7 (7 is bot bar).
        org     0
        clr     a
        jmp     init
        org     3
        jmp     intr

*Display BCD # in RB1 r6, different digit each time clk ticks
        org     7
        sel     rb1
        mov     r7,a        save ac
        in      a,p1        Which digit is displayed now?
        jb7     msd
        mov     a,r6        display LSD
        call    xlate
        mov     a,#0cfh     Select cathode 3
        outl    p1,a
        jmp     clkret
msd     mov     a,r6
        swap    a
        anl     a,#0fh      Test for leading zero
        jnz     callx
        mov     a,#0ah      10 = blank
callx   call    xlate
        mov     a,#3fh      Select cathode 2
        outl    p1,a
clkret  mov     a,#0c0h
        mov     t,a
        mov     a,r7        Restore ac
        retr

*Xlate subroutine - BCD to 7 seg.
xlate   anl     a,#0fh      Mask off left digit
        add     a,#xbase
        movp    a,@a
        mov     r3,a
        in      a,p2        Combine 7 seg data with PI bit
        anl     a,#80h
        orl     a,r3
        outl    p2,a
        ret
```

-continued

```
xbase   db      7eh
        db      30h
        db      6dh
        db      79h
        db      33h
        db      5bh
        db      1fh
        db      70h
        db      7fh
        db      73h
        db      0h

*interrupt routine - used when cable connects several units
*Signals end of game (you loose) and next game number
intr    sel     rb1
        mov     r7,a        Save AC
        sel     rb0
        clr     a
        cpl     a
        outl    bus,a       blank the box display
        mov     r3,a
        mov     a,#8eh      Set 7 seg. display to L
        outl    p2,a
iwait   in      a,p2        Wait for new game number
        cpl     a
        jb7     iwait       Jump if interrupt still at gnd
        inc     r3          Incr. new game no. cntr.
        mov     r1,#60h     Wait
ihere   djnz    r1,ihere    to see if inter. has ended
        in      a,p2
        cpl     a
        ib7     iwait       Jump if inter. still in progress
        call    xyss
        call    displa
        sel     rb1
        mov     a,r7        Restore AC
        retr

*Program starts here
init    sel     rb1
        mov     r6,a        (AC is already 0)
        sel     rb0
        outl    bus,a       Initialize display to check battery
        cpl     a
        mov     r2,a        set r2 to "box"
        mov     r3,#4       Select opening game
        strt    t           Start random number generator
        en      tcnti
start   en      i
start2  mov     r0,#20h
wait    djnz    r1,wait     wait for 200 ms of no buttons
        jnt0    start2
        in      a,p1
        cpl     a
        anl     a,#0fh
        jnz     start2
        djnz    r0,wait
nobut   jnt0    reset       Test for button pressed
        in      a,p1
        cpl     a
        anl     a,#0fh
        jz      nobut
        dis     i
        jf0     newgam      Test for game selection
        sel     rb1         Increment # moves counter
        mov     r4,a        save AC
        mov     a,r5
        add     a,#1
        da      a
        mov     r5,a
        mov     r6,a
        mov     a,r4        restore AC
        sel     rb0
        jb3     up          continuing game, get dir. of move
        jb2     dn
        jb1     lt
        jb0     rt
        jmp     start       hardware error if you get here
up      mov     a,r2        valid move?
        jb0     start       jmp if no
        inc     r4          yes
        jmp     out
```

-continued

```
dn      mov     a.r2
        jb1     start
        dec     r4
        jmp     out
lt      mov     a,r2
        jb3     start
        dec     r5
        jmp     out
rt      mov     a,r2
        jb2     start
        inc     r5
out     call    displa
        mov     a,r5        Test for end
        swap    a
        add     a,r4
        xr1     a,r7
        jnz     strt        Keep going
        clr     a           End
        out1    bus,a       Display box
        cp1     a
        mov     r2,a
        an1     p2,#7fh     Generate interrupt
me      jt0     me          Wait for reset button
reset   dis     i
        an1     p2,#7fh     Generate interupt
        clr     f0
        cp1     f0          Set flag
        clr     a           Clear Display
        sel     rb1
        mov     r5,a        clr moves cntr and register
        mov     r6,a
        sel     rb0
        mov     r2,a
        cpl     a
        out1    bus,a
        jmp     start2
newgam  clr     f0          Clear reset flag
        jb0     setss       repeat last game
        jb1     int
        jb2     beg
        jb3     adv
        jmp     start       error if pgm gets here
beg     mov     a,t         Get random number
        an1     a,#3        Mask it
        mov     r3,a
        jmp     setss
int     mov     a,t
        an1     a,#3
        or1     a,#4        Add offset
        mov     r3,a
        jmp     setss
adv     mov     a,t
        an1     a,#7
        or1     a,#8
        mov     r3,a
setss   mov     a,r3        Xmit game #
        ids     tcnti
        mov     r0,a
        inc     r0
xloop   or1     p2,#80h     clear interrupt
        djnz    r0,kt
        en      tcnti
        call    xyss
        call    displa
        jmp     start
kt      mov     r1,#40h     time delay for game # xmit routine
kt2     djnz    r1,kt2
        an1     p2,#7fh     Set interrupt
        mov     r1,#40h
kt3     djnz    r1,kt3
        jmp     xloop

*Display subroutine
displa  mov     a,r5        VERT BARS - set up cntr
        mov     r0,a
        inc     r0
        mov     a,r4        Get Y
        add     a,#8        add 8
        add     a,r6        add data table base addr
        movp3   a,@a        get data word
        clr     c           set carry
        cpl     c
```

-continued

```
        rrc     a
vrot    rlc     a           rotate X times
        djnz    r0,vrot
        anl     a,#0c0h     Get 2 bits
        mov     r2,a        Save them
horiz   mov     a,r4        HORIZ BARS - set up cntr
        mov     r0,a
        inc     r0
        mov     a,r5        Get X
        add     a,r6        add data table base addr
        movp3   a,@a
        clr     c
        cpl     c
        rrc     a
hrot    rlc     a
        djnz    r0,hrot
        anl     a,#0c0h
        rr      a
        rr      a
        add     a,r2
        mov     r2,a
        swap    a
        add     a,r2
        mov     r2,a
        cpl     a
        outl    bus,a
disret  ret

*XYSS subroutine - gets xystart, xyend, & min. # of moves from page 2
        org     200h
xyss    mov     a,r3        form xyend
        rl      a
        inc     a
        add     a,#0e0h
        movp    a,@a        get byte
        mov     r7,a        Save it
        mov     a,r3        form start loc.
        rl      a
        add     a,#0e0h
        movp    a,@a
        mov     r4,a
        swap    a
        anl     a,#0fh
        mov     r5,a
        mov     a,r4
        anl     a,#0fh
        mov     r4,a
        mov     a,r3        Get min # of moves
        add     a,#0d0h
        movp    a,@a
        sel     rb1
        mov     r6,a
        mov     r5,#0
        sel     rb0
        mov     a,r3
        swap    a           Multiply game # by 16
        mov     r6,a
        ret

        end
2d0: 9 9 8 13 21 13 16 18
28 32 32 20 37 35 25 30
0 3 20 3 23 10 30 0
0 5 20 45 15 0 50 45
30 27 12 7 40 75 32 7
7 60 1 75 2 7 72 27
98 d8 98 a8 0 0 0 0
98 e8 a8 88 0 0 0 0
90 98 d8 a8 0 0 0 0
a8 e8 c8 88 0 0 0 0
88 28 a8 c8 0 0 0 0
e8 a8 d8 a8 0 0 0 0
c8 b8 a8 c8 0 0 0 0
28 a8 98 a8 0 0 0 0
84 c6 c6 d6 be aa 0 0
8a d6 f2 f2 a2 82 0 0
82 92 e2 ba b8 d2 0 0
ca ea a2 a2 f7 cf 0 0
12 ba fe f2 ea d2 0 0
c2 82 86 8a d6 ca 0 0
92 fe ce 8e dc aa 0 0
96 9a aa 92 82 86 0 0
```

-continued

```
92 c9 ad d8 9a f8 b8 ac
a9 ac d0 a0 ca b6 9f a5
84 ac ec c5 94 d9 d1 80
c8 85 eb d9 8b b7 ee d0
8a 9d a8 f8 fb fd bd 96
e0 e1 a0 80 90 da ba a0
91 f9 ad ed dd d9 f7 82
a0 84 95 91 c2 ec 94 80
a5 9f 9f df e4 f2 75 a2
a2 d0 a8 85 8b 86 8a 84
a1 87 86 92 a8 9a 8c 86
aa ff f3 f1 da 8c 8b 96
95 ff ff d7 c7 c7 d4 88
80 c9 8f 8e 94 81 82 81
84 9e 9f dc 8a a5 9b 82
a4 fb ed 86 85 8a d4 a8
```

What is claimed is:

1. An electronic maze game comprising:

means for storing an electronic representation of a maze of at least two dimensions;

means for storing an electronic representation of a player's present position in said maze;

means coupled to said means for storing an electronic representation of a maze for displaying for said present position the presence or absence of a wall in the forward direction and the backward direction for each dimension of the maze said displaying means including an array of pairs of display elements, one pair for each dimension of the maze;

means for moving from said present position to an adjacent position in said maze; and means for testing for the validity of a move by testing for the presence of a wall in the direction of the move.

2. The electronic maze game of claim 1 further comprising:

means for connecting said maze game to a second said maze game;

means for playing the same maze simultaneously on both said maze games; and means for indicating when a player has completed one of said mazes before the other is completed.

3. The electronic maze game of claim 1 wherein the maze is a two-dimensional rectangular maze and the displaying means is a rectangular array of display elements, the left and right display elements indicating the presence and absence of walls in the backward and forward directions in one dimension of said maze, and the top and bottom display elements indicating the presence and absence of walls in the forward and backward directions of the second dimension.

4. The electronic maze game of claim 3 wherein the display elements are liquid crystals or light emitting diodes.

5. The electronic maze game of claim 1 further comprising means for displaying during play of the game the number of steps a player has taken through the maze.

6. The electronic maze game of claim 1 wherein in each array of pairs of display elements one of said display elements indicates the presence or absence of a wall in the backward direction in one dimension and the other indicates the presence or absence of absence of a wall in the forward direction in such dimension.

7. The electronic maze game of any one of claims 1, 3 or 6 wherein the means for moving comprises one pair of switches for each dimension of the maze, one of said switches signifying a move in the backward direction in such dimension and the other signifying a move in the forward direction, said switches being selectively actuatable by the player.

8. A method of operating an electronic maze game comprising the steps of:

storing an electronic representation of a maze of at least two dimentions;

storing an electronic representation of a player's present position in said maze;

displaying for said present position the presence or absence of a wall in the forward direction and the backward direction by an array of pairs of display elements, one pair for each dimension of the maze;

signifying an intended move from said present position to an adjacent position in said maze; and testing for the validity of said intended move by testing for the presence of a wall in the direction of the move.

* * * * *